US010422332B2

(12) United States Patent
Yin et al.

(10) Patent No.: US 10,422,332 B2
(45) Date of Patent: Sep. 24, 2019

(54) INTELLIGENT PUMP MONITORING AND CONTROL SYSTEM

(71) Applicant: CIRCOR PUMPS NORTH AMERICA, LLC, Monroe, NC (US)

(72) Inventors: Dan Yin, Waxhaw, NC (US); Kenneth Patton, Waxhaw, NC (US)

(73) Assignee: CIRCOR PUMPS NORTH AMERICA, LLC, Monroe, NC (US)

( * ) Notice: Subject to any disclaimer, the term of this patent is extended or adjusted under 35 U.S.C. 154(b) by 950 days.

(21) Appl. No.: 13/794,123

(22) Filed: Mar. 11, 2013

(65) Prior Publication Data

US 2014/0255215 A1 Sep. 11, 2014

(51) Int. Cl.
*F04B 49/00* (2006.01)
*F04B 49/10* (2006.01)
(Continued)

(52) U.S. Cl.
CPC ..... *F04B 49/00* (2013.01); *F04B 49/08* (2013.01); *F04B 49/103* (2013.01);
(Continued)

(58) Field of Classification Search
CPC ..... F04B 49/08; F04B 49/103; F04B 49/106; F04B 2205/02; F04B 2205/05; F04B 2205/07; F04B 2205/09; F04B 2205/10; F04B 2205/11; F04B 2205/14; F04B 2201/0802; F04B 49/00
See application file for complete search history.

(56) References Cited

U.S. PATENT DOCUMENTS 4,512,722 A 4/1985 Moutan
5,151,017 A 9/1992 Sears et al.
(Continued)

FOREIGN PATENT DOCUMENTS

CN 1321221 A 11/2001
CN 201330694 Y 10/2009
JP 2004537773 A 12/2004

OTHER PUBLICATIONS

Supplementary European Search Report dated Jul. 15, 2016 for European Patent Application No. 14779596.7 filed Feb. 25, 2014.
(Continued)

*Primary Examiner* — Bryan M Lettman

(57) ABSTRACT

A system and method for monitoring and controlling a pump includes defining processing targets, deriving a first actuator control signal Yc from the processing targets, and deriving actual operating parameters. Additionally, the actual operating parameters are compared to predefined system and pump limits to determine a second actuator control signal Y'c, the actual operating parameters are compared to predefined fluid limits to determine a third actuator control signal Y"c, the actual operating parameters are compared to predefined normal processing limits to determine a fourth actuator control signal Y'"c, and the actual operating parameters are compared to at least one predefined abnormal processing limit to determine a fifth actuator control signal Y""c. The most conservative actuator control signal is then determined, and the pump is driven in accordance with the most conservative actuator control signal.

20 Claims, 7 Drawing Sheets

(51) Int. Cl.
*F04B 49/08* (2006.01)
*F04C 2/16* (2006.01)
*F04C 14/28* (2006.01)

(52) U.S. Cl.
CPC ..... *F04B 49/106* (2013.01); *F04C 2/16* (2013.01); *F04C 14/28* (2013.01); *F04B 2201/0802* (2013.01); *F04B 2205/02* (2013.01); *F04B 2205/05* (2013.01); *F04B 2205/07* (2013.01); *F04B 2205/09* (2013.01); *F04B 2205/10* (2013.01); *F04B 2205/11* (2013.01); *F04B 2205/14* (2013.01); *F04C 2240/81* (2013.01); *F04C 2270/80* (2013.01); *F04C 2270/86* (2013.01)

(56) References Cited

U.S. PATENT DOCUMENTS 5,292,234 A 3/1994 Ling
5,601,414 A 2/1997 DiRe
5,742,109 A 4/1998 Volz et al.
5,801,467 A 9/1998 Volz et al.
6,099,264 A 8/2000 Du
6,155,653 A 12/2000 Borchert
6,167,965 B1 1/2001 Bearden et al.
6,203,282 B1 3/2001 Morin
6,464,464 B2 10/2002 Sabini et al.
6,487,903 B2 12/2002 Sabini et al.
6,564,627 B1 5/2003 Sabini et al.
6,607,360 B2 8/2003 Fong
6,648,606 B2 11/2003 Sabini et al.
6,663,349 B1 12/2003 Discenzo et al.
6,709,241 B2 3/2004 Sabini et al.
6,776,584 B2 8/2004 Sabini et al.
7,028,659 B2 * 4/2006 Schneider ..... F01M 1/02 123/196 R
7,080,508 B2 7/2006 Stavale et al.
7,112,037 B2 9/2006 Sabini et al.
7,619,382 B2 11/2009 Laing
7,746,063 B2 6/2010 Sabini et al.
7,945,411 B2 5/2011 Kernan et al.
8,249,826 B1 8/2012 Anderson et al.
2012/0104295 A1 * 5/2012 Do ..... G05B 9/03 251/129.01
2012/0195770 A1 * 8/2012 Anderson ..... E21B 47/042 417/18
2012/0282115 A1 11/2012 Du et al.

OTHER PUBLICATIONS

Search Report dated Jul. 22, 2016 for Chinese Patent Application No. 2014800134610 filed Feb. 25, 2014.

* cited by examiner

INTELLIGENT PUMP MONITORING AND CONTROL SYSTEM

FIELD OF THE DISCLOSURE

The disclosure is generally related to the field of monitoring systems for machinery, and more particularly to a system and method for continuous, automatic pump condition monitoring and control.

BACKGROUND OF THE DISCLOSURE

The condition of rotating machinery, such as pump, is often determined using visual inspection techniques that are performed by experienced operators. Failure modes such as cracking, leaking, corrosion, etc. can often be detected by visual inspection before failure is likely. Temperature and vibration are key indicators of a pump's operating performance. Excessive levels of either one may indicate a need for adjustment and/or repair.

Temperature variations across a surface can be manually measured using, for example, thermographic techniques. In addition, headphones can be used to listen to for undesirable wear conditions. For example, a high pitched buzzing sound in bearings may indicate flaws in contact surfaces.

The use of such manual condition monitoring allows adjustments to be made to pump operation, pump maintenance to be scheduled, or other actions to be taken, to avoid damage or pump failure that may otherwise occur if undesirable operating conditions are allowed to persist. Intervention in the early stages of deterioration is usually much more cost effective than undertaking repairs subsequent to failure.

One downside to manual monitoring is that such monitoring is typically only performed periodically. Thus, if an adverse condition arises between inspections, machinery failure can occur. Moreover, even with a properly trained workforce, manual monitoring is associated with errors, misjudgment, oversight, and a certain level of inconsistency of performance naturally attendant with any manual supervision of this type.

It would, therefore, be desirable to provide a system and method for constant and consistent monitoring of pump operating conditions. It would further be desirable to provide such a system and method that automatically adjust the manner in which a pump is operated to avoid damage and pump failure and improve pump efficiency. Such a system and method have the potential to enhance pump operation, reduce downtime, and increase energy efficiency. Such a system and method should be adapted for application to new machinery during manufacture or to be added as a retrofit to existing equipment.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

In accordance with the present disclosure, an intelligent method and system for monitoring and controlling a pump is provided. An exemplary embodiment of the method may include the steps of defining processing targets, deriving a first actuator control signal Yc from the processing targets, and deriving actual operating parameters. The method may further include the steps of comparing the actual operating parameters to predefined system and pump limits to determine a second actuator control signal Y'c, comparing the actual operating parameters to predefined fluid limits to determine a third actuator control signal Y"c, comparing the actual operating parameters to predefined normal processing limits to determine a fourth actuator control signal Y'"c, and comparing the actual operating parameters to at least one predefined abnormal processing limit to determine a fifth actuator control signal Y""c. The method may further include determining which of the actuator control signals is a most conservative actuator control signal and driving the pump in accordance with the most conservative actuator control signal.

An exemplary embodiment of a system in accordance with the present disclosure may include an actuator operatively connected to a pump for driving the pump in accordance with an actuator control signal, at least one sensor operatively connected to the pump for monitoring various operational parameters of the pump and a fluid that is pumped by the pump, and a controller operatively connected to the actuator and the at least one sensor. The controller may be configured to derive a first actuator control signal Yc from predefined processing targets and to derive actual operating parameters from information gathered from the at least one sensor. The controller may further be configured to compare the actual operating parameters to predefined system and pump limits to determine a second actuator control signal Y'c, compare the actual operating parameters to predefined fluid limits to determine a third actuator control signal Y"c, compare the actual operating parameters to predefined normal processing limits to determine a fourth actuator control signal Y'"c, and compare the actual operating parameters to predefined abnormal processing limits to determine a fifth actuator control signal Y""c. The controller may further be configured to determine which of the actuator control signals is a most conservative actuator control signal and to communicate the most conservative actuator control signal to the actuator.

BRIEF DESCRIPTION OF THE DRAWINGS

By way of example, specific embodiments of the disclosed device will now be described, with reference to the accompanying drawings, in which.

DETAILED DESCRIPTION

Figure 1:
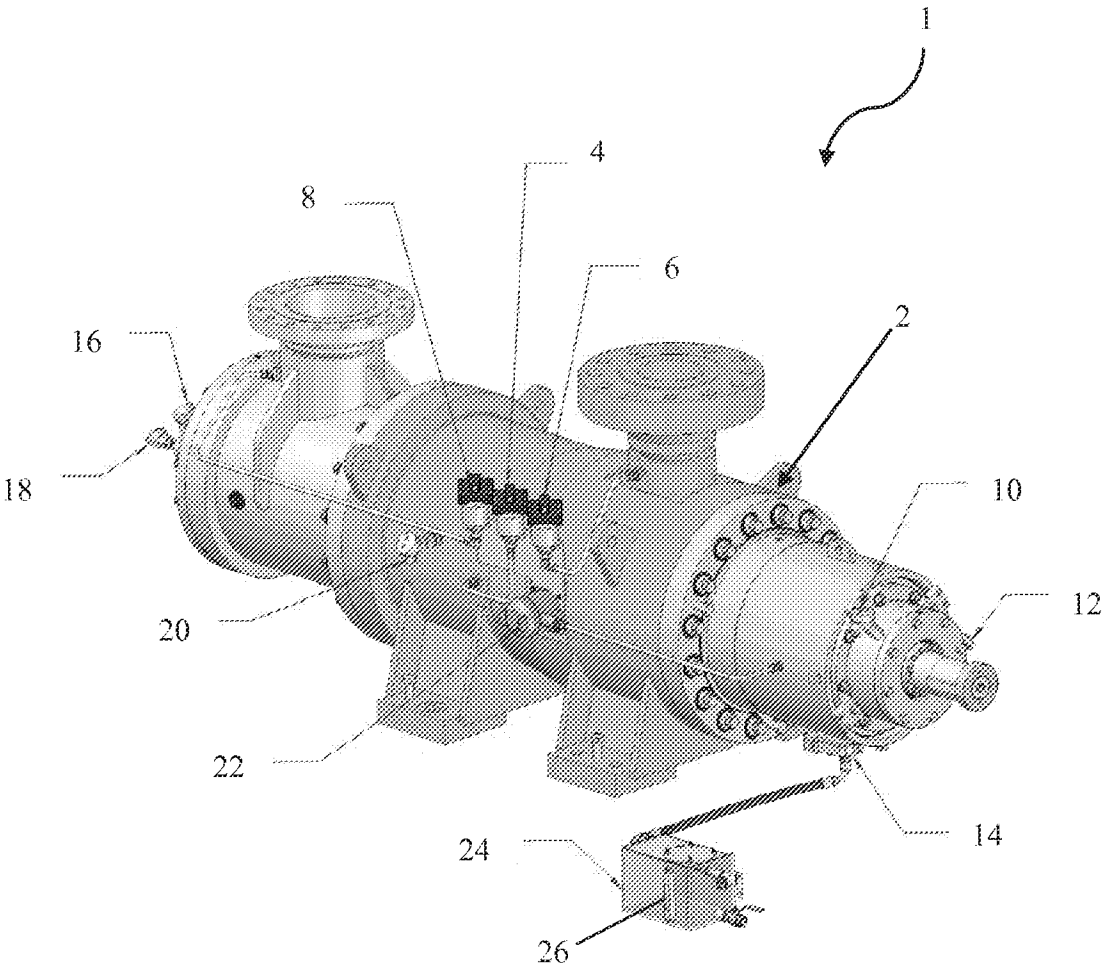
FIG. 1 is an isometric view illustrating an exemplary pump including a plurality of condition monitoring sensors mounted thereon.
Figure 2:
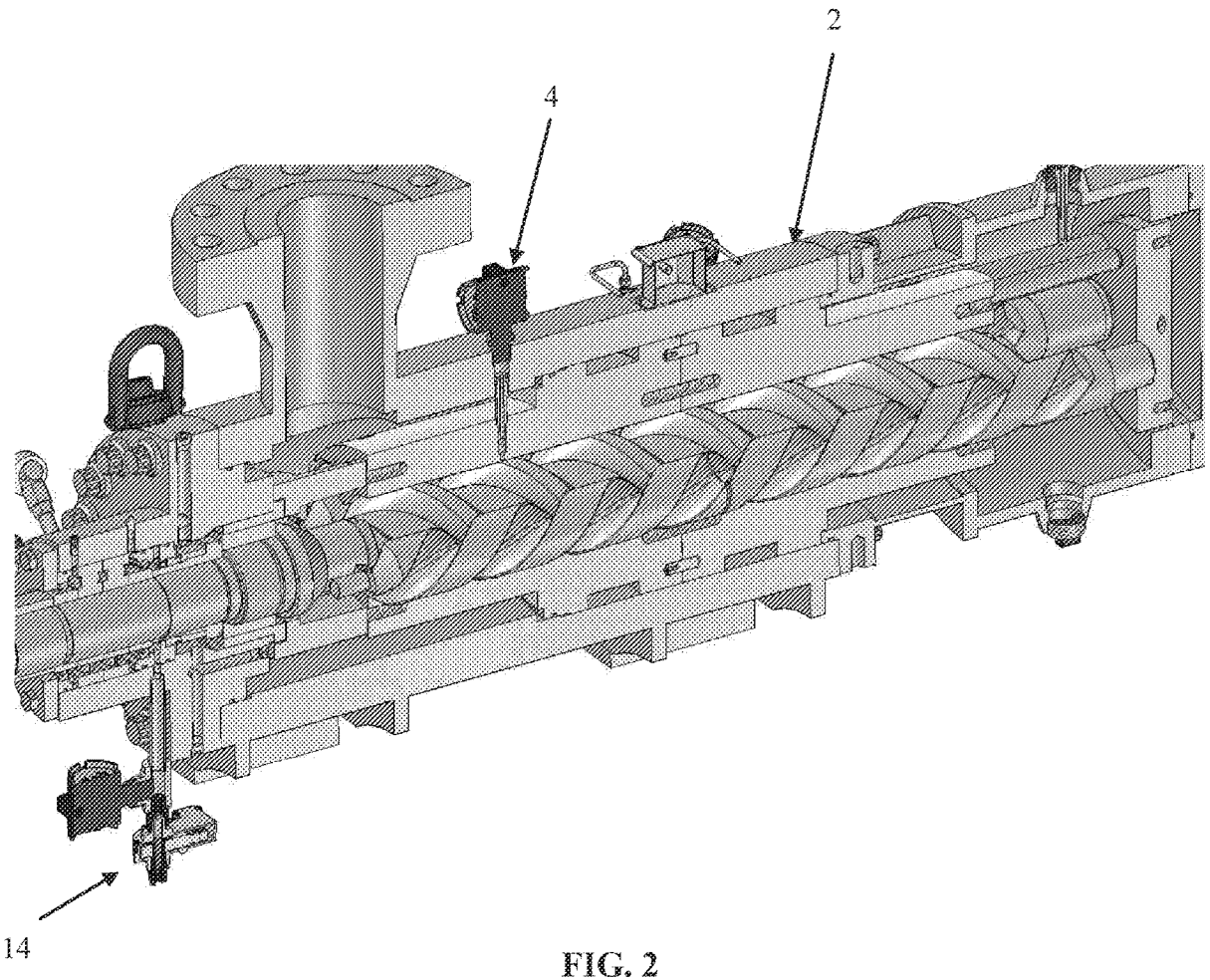
FIG. 2 is a cutaway view illustrating the pump of FIG. 1, detailing the position of two of the plurality of sensors mounted in relation to the pump's power rotor bore.
Figure 3:
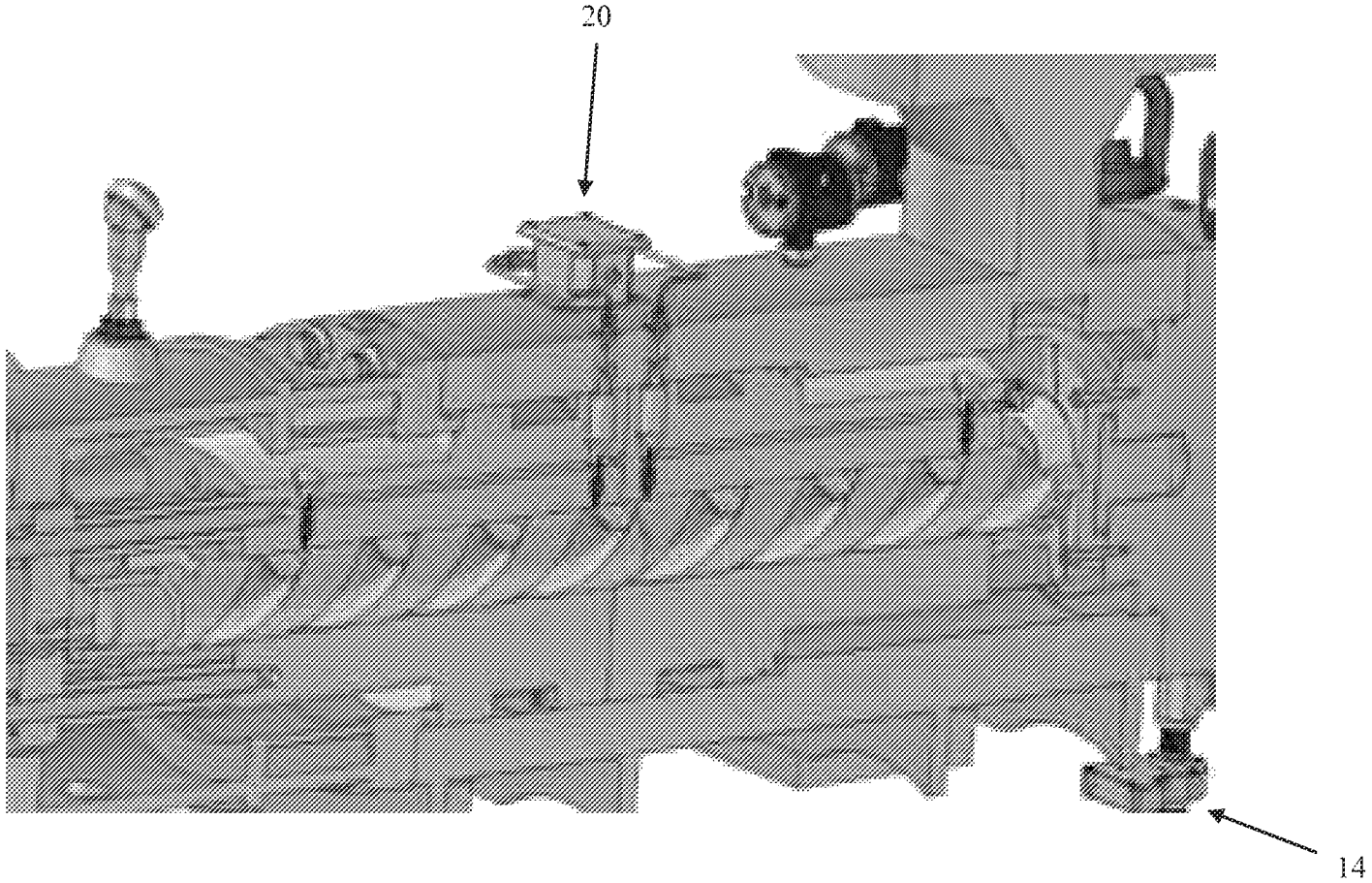
FIG. 3 is a cutaway view illustrating the pump of FIG. 2, detailing the position of two of the plurality of sensors mounted in relation to the pump's idler rotor bore.

Referring to FIGS. 1-3, an intelligent pump monitoring and control system 1 (hereinafter "the system 1") is shown mounted to an exemplary pump 2. The illustrated pump 2 is a multi-spindle screw pump, but it is contemplated that the system 1 and method described herein may be implemented in association with various other types of pumps, including centrifugal pumps, gear pumps, progressing cavity pumps.

The system 1 may include a variety of sensors mounted at appropriate locations throughout the pump 2. For example, the sensors may include a cavitation pressure transducer 4, a discharge pressure transducer 6, an inlet pressure transducer 8, a bearing vibration sensor 10, a bearing temperature sensor 12, a seal leak rate monitor 14, an idler vibration sensor 16, a thrust plate temperature sensor 18, and a casing wear detector 20. In the illustrated embodiment, the pump 2 is also provided with a catastrophic seal failure switch 22 and a seal leak tank 24 that is fit with a float switch 26. It is contemplated that the sensors 4 may include various additional sensors not mentioned above, including, but not limited to, various additional pressure, temperature, vibration, flow, viscosity, pump wear, leakage rate, and catastrophic leakage sensors. For the sake of convenience, the sensors 4-26 will hereinafter be collectively referred to as "the sensors 4." As will be appreciated by those of skill in the art, each of the sensors 4 is connected to the pump 2 at a location appropriate for collecting desired information relating to the operating condition of the pump 2 and a fluid that is being pumped by the pump 2.

Figure 4:
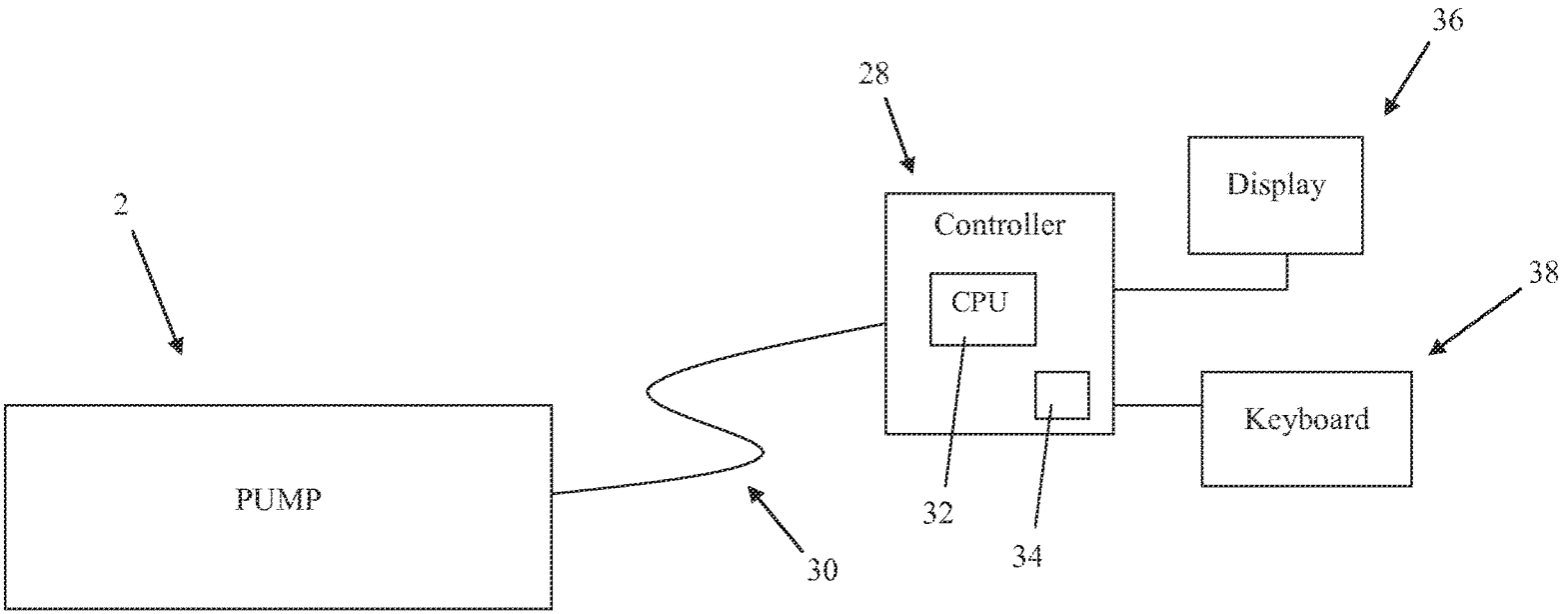
FIG. 4 is a schematic view illustrating the disclosed system.

FIG. 4 shows the system 1 including a controller 28 operatively coupled to the pump 2 via communications link 30. The controller 28 may be any suitable type of controller, including, but not limited to, a proportional-integral-derivative (PID) controller or a programmable logic controller (PLC). The communications link 30 is shown generically connected to the pump 2, but it will be appreciated that in practical application the communications link 30 may be coupled to the individual sensors 4, as well as to an electric actuator (not shown) that drives the pump 2 in response to an actuator control signal generated by the controller 28. The individual sensors 4 may send signals to controller 28 that are representative of one or more operating conditions of the pump 2. The controller 28 may include a processor 32 that executes software instructions for determining, from the received signals, whether the one or more operating conditions are within normal or desired limits, and for modifying the actuator control signal accordingly, as described in greater detail below. A non-volatile memory 34 may be associated with the processor 32 for storing software instructions and/or for storing data received from the sensors 4-26. A display 36 may be coupled to the controller 28 for providing local and/or remote display of information relating to the condition of the pump 2. An input device 38, such as a keyboard, may be coupled to the controller 28 for allowing a user to interact with the system 1.

The communications link 30 is illustrated as being a hard wired connection. It will be appreciated, however, that the communications link 30 can be embodied by any of a variety of wireless or hard-wired connections. For example, the communication link 30 can be implemented using Wi-Fi, a Bluetooth, PSTN (Public Switched Telephone Network), a satellite network system, a cellular network such as, for example, a GSM (Global System for Mobile Communications) network for SMS and packet voice communication, General Packet Radio Service (GPRS) network for packet data and voice communication, or a wired data network such as, for example, Ethernet/Internet for TCP/IP, VOIP communication, etc.

Figure 5:
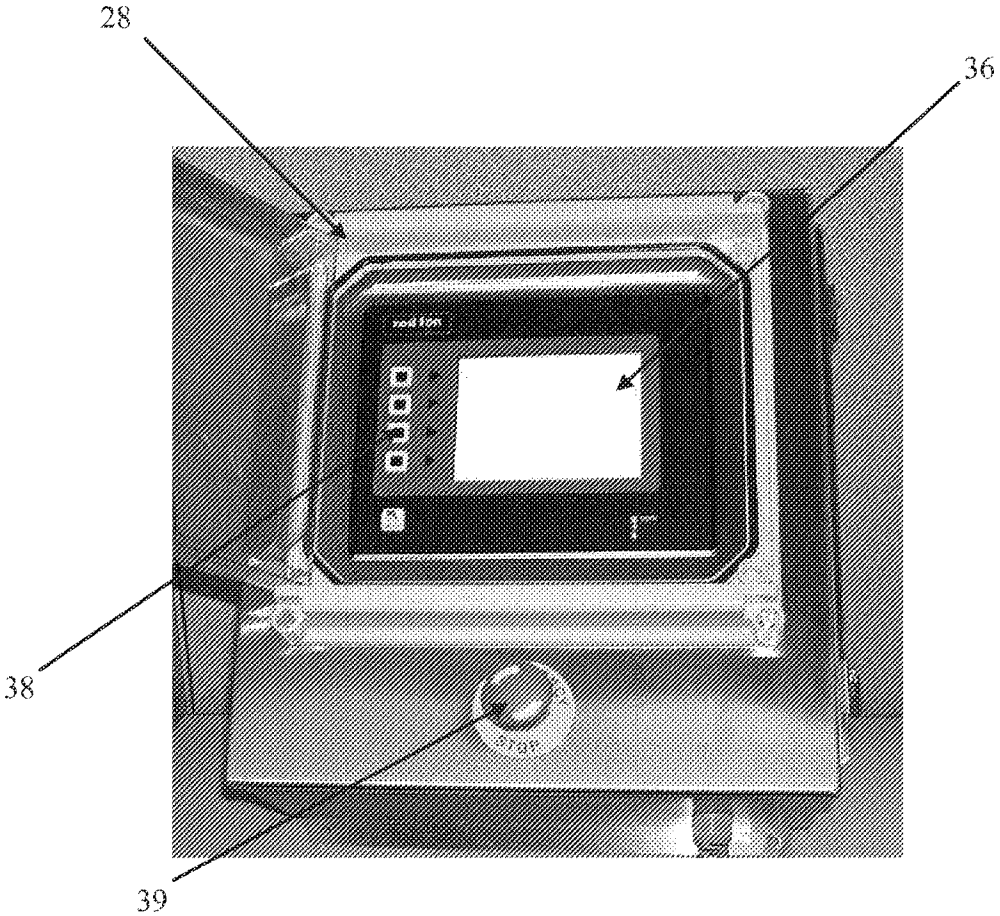
FIG. 5 is an isometric view illustrating an exemplary controller for use with the system shown in FIG. 4.

FIG. 5 shows an exemplary implementation of a controller 28, including display 36 and keyboard 38, which in this embodiment is provided as a touch screen display. The controller 28 may be configured for a variety of indoor or outdoor applications. In the illustrated embodiment, the controller 28 includes a stainless steel enclosure, with a color touch screen enclosed by a polycarbonate sealed clear cover to block ultraviolet light rays. The controller 28 may be configured for class I, Div 2 hazardous areas. All signals received by, and generated by, the controller 28 may be isolated using appropriate IS barriers. The enclosure may be sealed, purged, pressurized and monitored by an enclosure pressure control system to ensure no flammable gas or vapor enters the enclosure. As noted, the enclosure (including the controller 28) can be mounted near the pump 2, or at a remote safe zone.

The controller 28 may include an emergency stop switch 39 for remotely controlling the system's main circuit breakers to stop the pump in the event of an emergency. It is contemplated that the controller 28 may further include a pre-heater (not shown) to enable the system to operate in cold environments (e.g., down to −45° C. (−49° F.)). Still further, it is contemplated that a hygrostat and fan heater (not shown) can also be implemented to monitor and control humidity within the controller 28.

Figure 6:
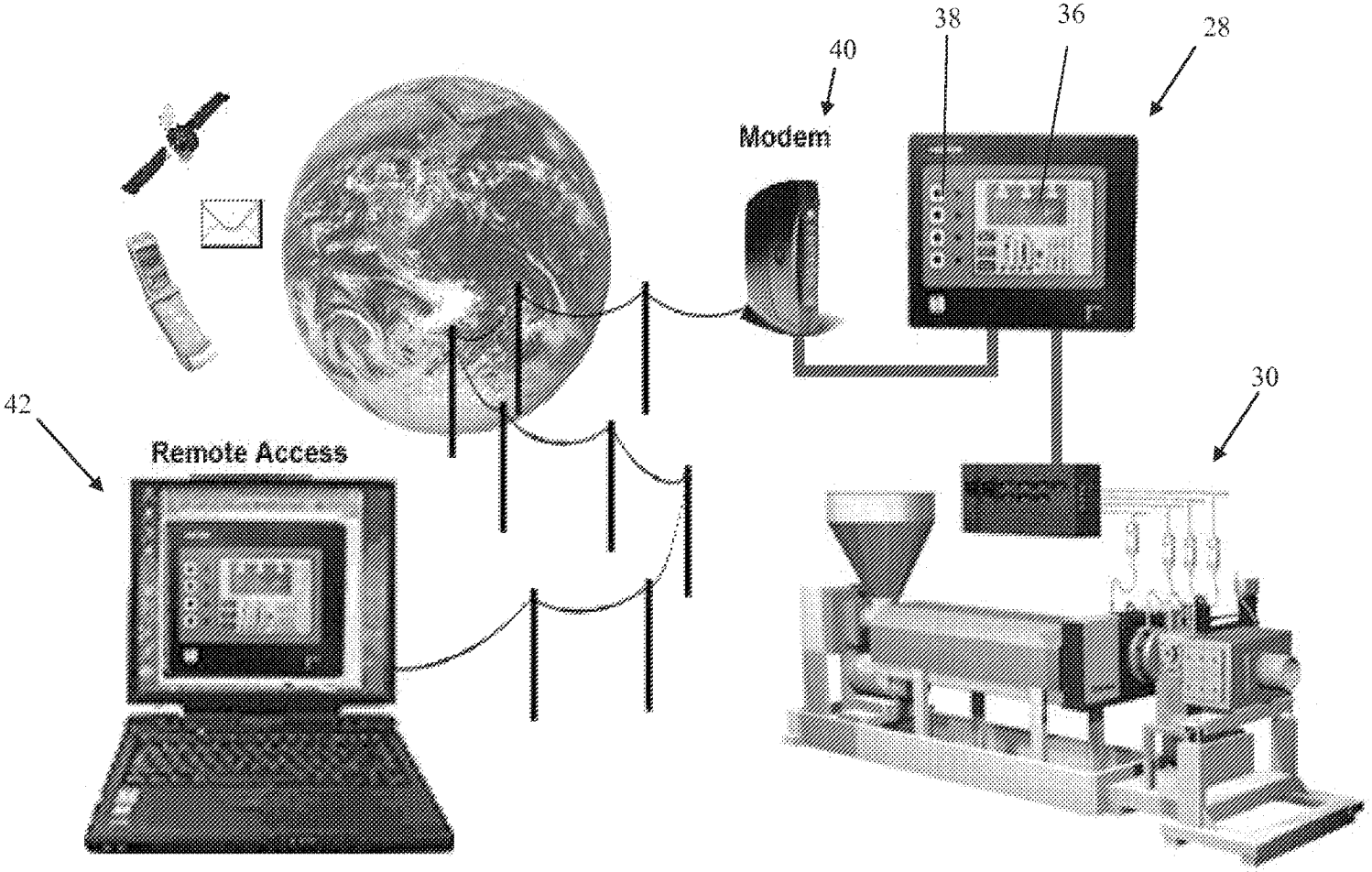
FIG. 6 is a schematic view illustrating the system of FIG. 4 expanded to include remote monitoring.

FIG. 6 shows an embodiment of the system 1 that includes remote access capability. As described above, the system 1 includes pump 2 with a plurality of sensors coupled to a controller 28 via a communications link 30. The controller 28 includes a local display 36 and keyboard 38. The controller 28 of this embodiment is coupled to a modem 40 which enables a remote computer 42 to access the controller 28. The remote computer 42 may be used to display information that is substantially identical to that displayed locally at the controller 28. The modem 40 may enable the controller 28 to promulgate e-mail, text messages, and pager signals to alert a user about the condition of the pump 2 being monitored. Such communications to and from the controller can be effectuated via an integrated server (not shown) that enables remote access to the controller 28 via the Internet. In addition, data and/or alarms can be transferred thru one or more of e-mail, Internet, Ethernet, RS-232/422/485, CANopen, DeviceNet, Profitbus, RF radio, Telephone land line, cellular network and satellite networks.

Figure 7:
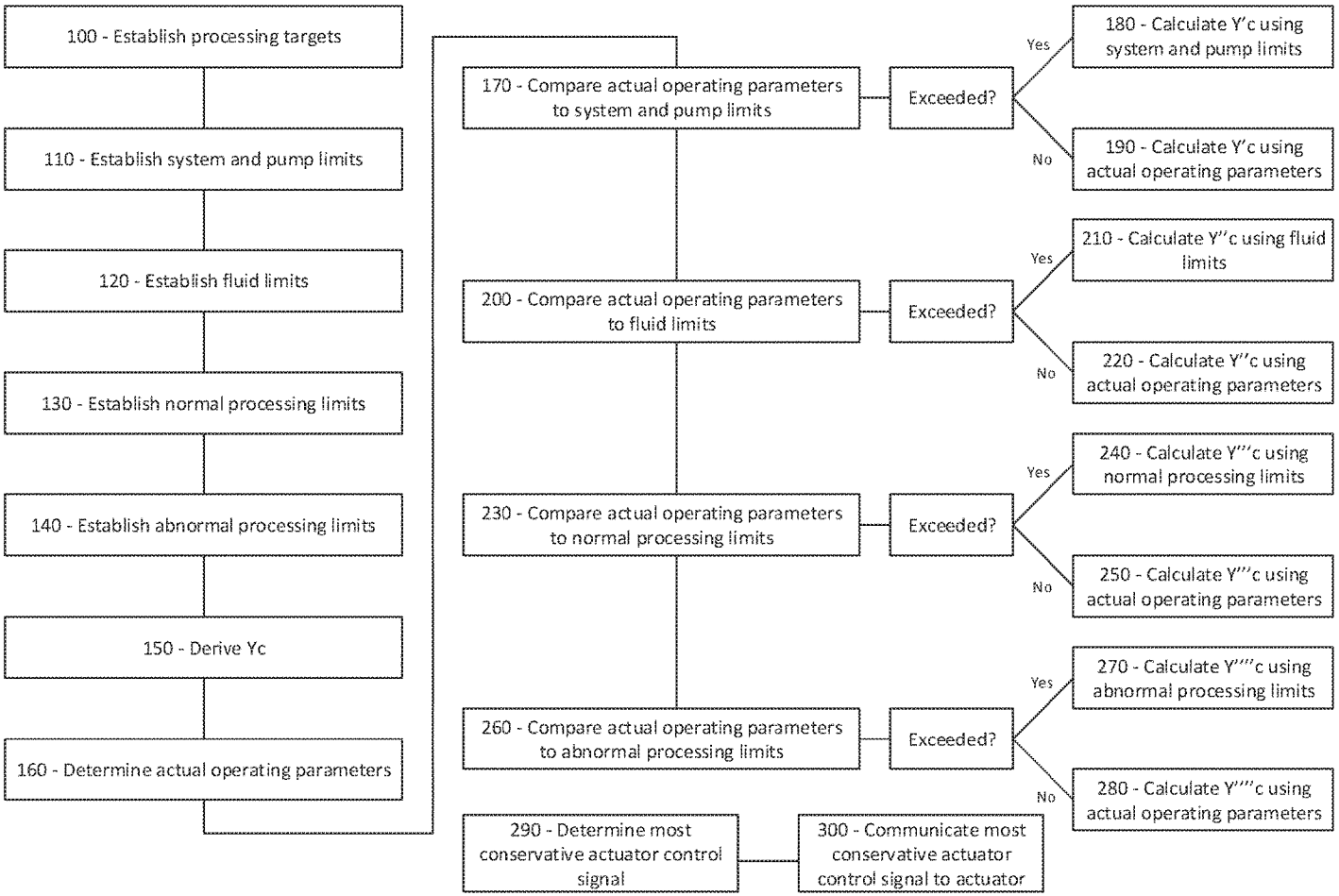
FIG. 7 is a flow diagram illustrating an example of the disclosed method.

Referring to FIG. 7, a flow diagram illustrating an exemplary method of operating the pump 2 in accordance with the present disclosure is shown. Unless otherwise specified, the depicted method may be performed wholly or in part by a software algorithm, such as may be stored in the memory 34 and executed by the processor 32 of the controller 28.

At step 100 of the method, one or more "processing targets" may be established in the controller 28, such as by defining the targets in the algorithm executed by the processor 32 of the controller 28. This may be performed during the initial configuration of the controller 28 (e.g. upon installation) or at a later time. Processing targets may include various desirable operating parameters, such as optimal pump and fluid characteristics, which are sought to be achieved and/or maintained during operation of the pump 2. Exemplary processing targets include, but are not limited to, a target pump speed, a target pump suction pressure, a target pump differential pressure, a target pump discharge pressure, a target pump flow, and a target fluid temperature. The particular processing targets that are specified and the value of each specified target may depend on a number of factors, such as the particular type of pump being used, the particular process that is being executed by the pump 2, and the particular fluid that is being pumped.

At step 110 of the method, one or more predefined "system and pump limits" may be established in the controller 28, such as by defining the limits in the algorithm executed by the processor 32 of the controller 28. This may be performed during the initial configuration of the controller 28 (e.g. upon installation) or at a later time. System and pump limits may include various operational boundary values (e.g. minimum values and/or maximum values) within which the system 1 and the pump 2 should operate under normal conditions. Exemplary system and pump limits may include, but are not limited to, system speed limits (e.g. engine or electric motor speeds), system pressure limits, system flow rate limits, system temperature limits, pump speed limits, pump suction pressure limits, pump discharge pressure limits, pump differential pressure limits, pump viscosity limits, and pump vibration limits. Generally, system limits are physical or design limits for a whole system and may be broader or narrower than the pump limits since the system limits are determined by other factors beyond those that are associated with the pump 2. For example, factors that dictate the system limits may be related to system components that are external to the pump 2, such as an electric motor, an engine, a coupling, a load, etc. Therefore, the pump limits may fall within the system limits or vice versa, or the two sets of limits may partially overlap.

At step 120 of the method, one or more predefined "fluid limits" may be established in the controller 28, such as by defining the limits in the algorithm executed by the processor 32 of the controller 28. This may be performed during the initial configuration of the controller 28 (e.g. upon installation) or at a later time. Fluid limits may include various operational boundary values (e.g. minimum values and/or maximum values) associated with a specific fluid that is being pumped, wherein such boundary values should not be traversed during normal operation of the pump 2. Exemplary fluid limits may include, but are not limited to, viscosity limits over a defined temperature range, temperature limits, specific gravity limits, air content limits, solid content quantity and size limits, and different fluid (i.e. fluids other than the fluid that is intended to be pumped) quantity limits.

At step 130 of the method, one or more predefined "normal processing limits" may be established in the controller 28, such as by defining the limits in the algorithm executed by the processor 32 of the controller 28. This may be performed during the initial configuration of the controller 28 (e.g. upon installation) or at a later time. Normal processing limits may include various operational boundary values (e.g. minimum values and/or maximum values) associated with a particular process that is executed by the pump 2. Such processing limits will normally fall within the system and pump limits described above. That is, the limits associated with a particular process will generally not exceed the designated operational capabilities of the system 1 and the pump 2. Exemplary normal processing limits may include, but are not limited to, processing speed limits, processing suction pressure limits, processing discharge pressure limits, processing differential pressure limits, processing flow rate limits, processing temperature limits, and processing vibration limits.

At step 140 of the method, one or more predefined "abnormal processing limits" may be established in the controller 28, such as by defining the limits in the algorithm executed by the processor 32 of the controller 28. This may be performed during the initial configuration of the controller 28 (e.g. upon installation) or at a later time. Abnormal processing limits may include various operational boundary values (e.g. minimum values and/or maximum values) associated with the operation of the pump 2 that may be indicative of certain abnormal processing conditions, such as cavitation or dry-running. Exemplary abnormal processing limits may include, but are not limited to, a cavitation severity limit, a dry-running severity limit, an air bubble severity limit, a pump flow as a flow meter limit, a pump efficiency limit, a bearing lubrication health limit, a leak rate and trend limit, a severe external leakage limit, and a fast Fourier transform (FFT) analysis from vibration limit.

At step 150 of the method, a first actuator control signal Yc may be derived wholly or in part from the predefined processing targets described above, wherein Yc may be a control signal that is intended to drive the pump 2 in a manner that is consistent with the processing targets, such as at a target speed, pressure, temperature, etc. For example, Yc may be the product of an algorithm executed by the processor 32 of the controller 28, which algorithm takes into account the predefined processing target values as well as certain, known characteristics of the pump 2, such as the dimensions and capacity of the pump 2.

At step 160 of the method, one or more actual operating parameters may be determined, such as by direct measurement by the sensors 4, by calculation based on measured parameters, or by calculation based on a combination of measured and known parameters. For example, with regard to directly measured parameters, actual inlet and discharge pump pressures may be directly measured, such as by the inlet and discharge pressure transducers 6 and 8 described above. An actual pump speed may be measured, such as by an encoder or other speed sensor attached to a motor (not shown) that is coupled to the pump 2, or may be read from a variable speed drive (not shown) that is coupled to the pump 2. An actual pump temperature may be measured by the bearing temperature sensor 12 or the thrust plate temperature sensor 18. An actual pump vibration level may be measured, such as by the bearing vibration sensor 10 or by the idler vibration sensor 16. An actual pump flow rate may be measured, such as by a flow meter (not shown) located at the discharge side of the pump 2. An actual fluid temperature may be measured, such as by a thermocouple, a resistance temperature detector (RTD), or any other suitable means of temperature measurement (not shown) that is submerged in, or that is proximate, the fluid being pumped. An actual fluid viscosity may be measured, such as by a viscometer (not shown) located at the discharge side of the pump 2. An actual specific gravity of the pumped fluid may be measured, such as by a mass flowmeter (not shown) located at the discharge side of the pump 2. Actual solid content, air content, and different fluid levels may be measured, such as by one or more cameras that may be submerged in, or that may be proximate to, the fluid being pumped in conjunction with software that is configured to process images captured by the camera(s) to determine such levels.

With regard to calculated actual operating parameters, an actual differential pump pressure may be calculated, such as by the processor 32, as the difference between the actual inlet and discharge pressures. A cavitation severity level may be calculated as a ratio between the difference between the interstage pump pressure (as measured by the cavitation pressure transducer 4) and the inlet pump pressure and the difference between the discharge pump pressure and the inlet pump pressure. A dry-running severity level may be calculated as the standard deviation magnitude (or variations thereof) of the cavitation severity level. An air bubble severity level may also be calculated as the standard deviation magnitude (or variations thereof) of the cavitation severity level (a greater ration of air to liquid will generally be interpreted as a dry-running condition white a greater ratio of liquid to air may indicate air bubbles). A pump efficiency level can be calculated as a function of the pump capacity, the pump wear level (such as may be measured by the casing wear detector 20), the fluid viscosity, the pump speed, the inlet pump pressure, and the discharge pump pressure. A pump flow as a flow meter level can be calculated as a function of the pump capacity, the pump wear level, the fluid viscosity, the pump speed, the inlet pump pressure, the discharge pump pressure, and the pump efficiency level. A bearing lubrication health level can be calculated as a function of the pump dimensions, the fluid viscosity, the pump speed, the inlet pump pressure, the discharge pump pressure, and the pump flow rate. A leak rate and trend level may be calculated as a function of the fluid height in the seal leak tank 24 (such as may be measured by the float switch 26) and time. A severe external leakage limit may be calculated as a function of the pump capacity, the pump efficiency level, the pump speed, and the pump flow rate. A FFT analysis from vibration level can be calculated from the measured pump vibration level.

At step 170 of the method, one or more of the actual operating parameters relating to the pump 2 that were measured or calculated as described above may be compared to the corresponding, predefined system and pump limits described above. Such comparisons may be performed by the processor 32. For example, the actual pump speed may be compared to the predefined pump and system speed limits. The actual pump pressures (i.e. inlet, discharge, and differential) may be compared to the predefined pump and system pressure limits. The actual pump flow rate may be compared to the predefined pump and system flow rate limits. The actual pump temperature may be compared to the predefined pump and system temperature limits. The actual fluid viscosity may be compared to the predefined pump viscosity limits. The actual pump vibration level may be compared to the predefined pump vibration limits.

At step 180 of the method, if it was determined in step 170 that any of the actual operating parameters relating to the pump 2 did not fall within the corresponding, predefined system and pump limits, a second, corrected actuator control Y'c signal (i.e. corrected relative to the first actuator control signal Yc) may be calculated that is intended to drive the pump 2 in a manner that brings the actual operating parameters within the predefined system and pump limits. Particularly, Y'c may be calculated as a function of the processing targets (described above), the predefined system and pump limits, and the first actuator control signal Yc.

At step 190 of the method, if it was determined in step 170 that all of the actual operating parameters relating to the pump 2 did fall within the corresponding, predefined system and pump limits, a second, corrected actuator control Y'c signal (i.e. corrected relative to the first actuator control signal Yc) may be calculated that is intended to drive the pump 2 in a manner that brings the actual operating parameters closer to the predefined processing targets (described above). Particularly, Y'c may be calculated as a function of the processing targets, the actual operating parameters, and the first actuator control signal Yc.

At step 200 of the method, one or more of the actual operating parameters relating to the pumped fluid that were measured or calculated as described above may be compared to the corresponding, predefined fluid limits described above. Such comparisons may be performed by the processor 32. For example, the actual fluid viscosity over a temperature range may be compared to the predefined viscosity limits over a defined temperature range. The actual fluid temperature may be compared to the predefined fluid temperature limits. The actual specific gravity of the fluid may be compared to the predefined fluid gravity limits. The actual solid content quantity and size levels in the fluid may be compared to the predefined solid content quantity and size limits. The actual different fluid quantity level in the fluid may be compared to the predefined different fluid quantity limits. The actual fluid viscosity may be compared to the predefined pump viscosity limits.

At step 210 of the method, if it was determined in step 200 that any of the actual operating parameters relating to the pumped fluid did not fall within the corresponding, predefined fluid limits, a third, corrected actuator control Y"c signal (i.e. corrected relative to the first actuator control signal Yc) may be calculated that is intended to drive the pump 2 in a manner that brings the actual operating parameters within the predefined fluid limits. Particularly, Y"c may be calculated as a function of the processing targets (described above), the predefined fluid limits, and the first actuator control signal Yc.

At step 220 of the method, if it was determined in step 200 that all of the actual operating parameters relating to the fluid did fall within the corresponding, predefined system and pump limits, a third, corrected actuator control Y"c signal (i.e. corrected relative to the first actuator control signal Yc) may be calculated that is intended to drive the pump 2 in a manner that brings the actual operating parameters closer to the predefined processing targets (described above). Particularly, Y'c may be calculated as a function of the processing targets, the actual operating parameters, and the first actuator control signal Yc.

At step 230 of the method, one or more of the actual operating parameters relating to the pump 2 that were measured or calculated as described above may be compared to the corresponding, predefined normal processing limits described above. Such comparisons may be performed by the processor 32. For example, the actual pump speed may be compared to the predefined processing speed limits. The actual pump pressures (i.e. inlet, discharge, and differential) may be compared to the predefined processing pressure limits. The actual pump flow rate may be compared to the predefined processing flow rate limits. The actual pump temperature may be compared to the predefined processing temperature limits. The actual pump vibration level may be compared to the predefined processing vibration limits.

At step 240 of the method, if it was determined in step 230 that any of the actual operating parameters relating to the pump 2 did not fall within the corresponding, predefined normal processing limits, a fourth, corrected actuator control Y'"c signal (i.e. corrected relative to the first actuator control signal Yc) may be calculated that is intended to drive the pump 2 in a manner that brings the actual operating parameters within the predefined normal processing limits. Particularly, Y'"c may be calculated as a function of the processing targets (described above), the predefined normal processing limits, and the first actuator control signal Yc.

At step 250 of the method, if it was determined in step 230 that all of the actual operating parameters relating to the pump 2 did fall within the corresponding, predefined normal processing limits, a fourth, corrected actuator control Y'"c signal (i.e. corrected relative to the first actuator control signal Yc) may be calculated that is intended to drive the pump 2 in a manner that brings the actual operating parameters closer to the predefined processing targets (described above). Particularly, Y'"c may be calculated as a function of the processing targets, the actual operating parameters, and the first actuator control signal Yc.

At step 260 of the method, one or more of the actual operating parameters relating to the pump 2 and the fluid that were measured or calculated as described above may be compared to the corresponding, predefined abnormal processing limits described above. Such comparisons may be performed by the processor 32. For example, the actual cavitation severity level may be compared to the predefined cavitation severity limit. The actual dry-running severity level may be compared to the predefined dry-running severity limit. The actual air bubble severity level may be compared to the predefined air bubble severity limit. The actual pump flow as a flowmeter level may be compared to the predefined pump flow as a flowmeter limit. The actual pump efficiency level may be compared to the predefined pump efficiency limit. The actual bearing lubrication health level may be compared to the predefined bearing lubrication health limit. The actual leak rate and trend level may be compared to the predefined leak rate and trend limit. The actual severe external leakage level may be compared to the predefined severe external leakage limit. The actual FFT analysis from vibration level may be compared to the predefined FFT analysis from vibration limit.

At step 270 of the method, if it was determined in step 260 that any of the actual operating parameters relating to the pump 2 and the fluid did not fall within the corresponding, predefined abnormal processing limits, a fifth, corrected actuator control signal Y""c (i.e. corrected relative to the first actuator control signal Yc) may be calculated that is intended to drive the pump 2 in a manner that brings the actual operating parameters within the predefined abnormal processing limits. Particularly, Y""c may be calculated as a function of the processing targets (described above), the predefined abnormal processing limits, and the first actuator control signal Yc.

At step 280 of the method, if it was determined in step 260 that all of the actual operating parameters relating to the pump 2 and the fluid did fall within the corresponding, predefined abnormal processing limits, a fifth, corrected actuator control Y""c signal (i.e. corrected relative to the first actuator control signal Yc) may be calculated that is intended to drive the pump 2 in a manner that brings the actual operating parameters closer to the predefined processing targets (described above). Particularly, Y""c may be calculated as a function of the processing targets, the actual operating parameters, and the first actuator control signal Yc.

At step 290 of the method, the processor 32 of the controller 28 may determine which of the corrected actuator control signals Y'c, Y"c, Y'"c, or Y""c (calculated as described above) is a "most conservative" actuator control signal. A most conservative one of the corrected actuator control signals Y'c, Y"c, Y'"c, or Y""c may be the signal that will drive the pump 2 at a lowest speed, pressure, temperature, flow rate, etc., or that will otherwise drive the pump 2 in a manner that will be least likely to exceed the predefined operational limits described above (i.e. system and pump limits, fluid limits, normal processing limits, and abnormal processing limits) relative to the other corrected signals.

At step 300 of the method, the most conservative actuator control signal (i.e. Y'c, Y"c, Y'"c, or Y""c) that was determined in step 290 is communicated to the actuator by the controller 28. The pump 2 is thereby driven in accordance with the most conservative actuator control signal. Therefore, the pump 2 is continuously operated in a manner that mitigates the risk of damage or failure while simultaneously optimizing pump efficiency.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Some embodiments of the disclosed device may be implemented, for example, using a storage medium, a computer-readable medium or an article of manufacture which may store an instruction or a set of instructions that, if executed by a machine, may cause the machine to perform a method and/or operations in accordance with embodiments of the disclosure. Such a machine may include, for example, any suitable processing platform, computing platform, computing device, processing device, computing system, processing system, computer, processor, or the like, and may be implemented using any suitable combination of hardware and/or software. The computer-readable medium or article may include, for example, any suitable type of memory unit, memory device, memory article, memory medium, storage device, storage article, storage medium and/or storage unit, for example, memory (including non-transitory memory), removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

The invention claimed is:

1. A method for monitoring and controlling a pump, comprising:

defining at least one processing target;

deriving a first actuator control signal Yc from the at least one processing target;

deriving at least one actual operating parameter;

comparing the at least one actual operating parameter to at least one predefined system and pump limit to determine a second actuator control signal Y'c;

comparing the at least one actual operating parameter to at least one predefined fluid limit to determine a third actuator control signal Y"c;

comparing the at least one actual operating parameter to at least one predefined normal processing limit to determine a fourth actuator control signal Y'"c;

comparing the at least one actual operating parameter to at least one predefined abnormal processing limit to determine a fifth actuator control signal Y""c;

determining which of the second actuator control signal Y'c, third actuator control signal Y"c, fourth actuator control signal Y'"c, and fifth actuator control Y""c signals is a most conservative actuator control signal; and driving the pump in accordance with the most conservative actuator control signal.

2. The method of claim 1, wherein the step of comparing the at least one actual operating parameter to the at least one predefined system and pump limit to determine the second actuator control signal Y'c comprises:

if the at least one actual operating parameter exceeds the at least one predefined system and pump limit, calculating the second actuator control signal Y'c based on a function of the at least one processing target, the at least one predefined system and pump limit, and the first actuator control signal; and if the actual operating speed does not exceed the at least one predefined system and pump limit, calculating the second actuator control signal Y'c based on a function of the at least one processing target, the at least one actual operating parameter, and the first actuator control signal.

3. The method of claim 1, wherein the step of comparing the at least one actual operating parameter to the at least one predefined fluid limit to determine the third Y"c actuator control signal comprises:

if the at least one actual operating parameter exceeds the at least one predefined fluid limit, calculating the third actuator control signal Y"c based on a function of the at least one processing target, the at least one predefined system and pump limit, and the first actuator control signal; and if the actual operating speed does not exceed the at least one predefined fluid limit, calculating the third actuator control signal Y"c based on a function of the at least one processing target, the at least one actual operating parameter, and the first actuator control signal.

4. The method of claim 1, wherein the step of comparing the at least one actual operating parameter to the at least one predefined normal processing limit to determine the fourth actuator control signal Y'"c comprises:

if the at least one actual operating parameter exceeds the at least one predefined normal processing limit, calculating the fourth actuator control signal Y'"c based on a function of the at least one processing target, the at least one predefined normal processing limit, and the first actuator control signal; and if the actual operating speed does not exceed the at least one predefined normal processing limit, calculating the fourth actuator control signal Y'"c based on a function of the at least one processing target, the at least one actual operating parameter, and the first actuator control signal.

5. The method of claim 1, wherein the step of comparing the at least one actual operating parameter to the at least one predefined abnormal processing limit to determine the fifth actuator control signal Y""c comprises:

if the at least one actual operating parameter exceeds the at least one predefined abnormal processing limit, calculating the fifth actuator control signal Y""c based on a function of the at least one processing target, the at least one predefined abnormal processing limit, and the first actuator control signal; and if the actual operating speed does not exceed the at least one predefined abnormal processing limit, calculating the fifth actuator control signal Y""c based on a function of the at least one processing target, the at least one actual operating parameter, and the first actuator control signal.

6. The method of claim 1, wherein the at least one processing target includes at least one of a target pump speed, a target pump suction pressure, a target pump differential pressure, a target pump discharge pressure, a target pump flow, and a target fluid temperature.

7. The method of claim 1, wherein the at least one system and pump limit includes at least one of a system speed limit, a system pressure limit, a system flow rate limit, a system temperature limit, a pump speed limit, a pump suction pressure limit, a pump discharge pressure limit, a pump differential pressure limit, a pump viscosity limit, and a pump vibration limit.

8. The method of claim 1, wherein the at least one normal processing limit includes at least one of a processing speed limit, processing suction pressure limit, processing discharge pressure limit, processing differential pressure limit, processing flow rate limits, processing temperature limit, and a processing vibration limit.

9. The method of claim 1, wherein the at least one abnormal processing limit includes at least one of a cavitation severity limit, a dry-running severity limit, an air bubble severity limit, a pump flow as a flow meter limit, a pump efficiency limit, a bearing lubrication health limit, a leak rate and trend limit, a severe external leakage limit, and a FFT analysis from vibration limit.

10. The method of claim 1, wherein the most conservative actuator control is associated with at least one of a lowest pump speed, a lowest pump pressure, a lowest pump temperature, and a lowest pump flow rate.

11. A system for monitoring and controlling a pump, comprising:

an actuator operatively connected to the pump for driving the pump in accordance with an actuator control signal;

at least one sensor operatively connected to the pump for monitoring various operational parameters of the pump and a fluid that is pumped by the pump;

a controller operatively connected to the actuator and the at least one sensor, wherein the controller is configured to:

derive a first actuator control signal Yc from at least one predefined processing target;

derive at least one actual operating parameter from information gathered from the at least one sensor;

compare the at least one actual operating parameter to at least one predefined system and pump limit to determine a second actuator control signal Y' c;

compare the at least one actual operating parameter to at least one predefined fluid limit to determine a third actuator control signal Y"c;

compare the at least one actual operating parameter to at least one predefined normal processing limit to determine a fourth actuator control signal Y'''c;

compare the at least one actual operating parameter to at least one predefined abnormal processing limit to determine a fifth actuator control signal Y''''c;

determine which of the second actuator control signal Y'c, third actuator control signal Y''c, fourth actuator control signal Y'''c, and fifth actuator control Y''''c signals is a most conservative actuator control signal; and communicate the most conservative actuator control signal to the actuator.

12. The system of claim 11, wherein the controller is configured to calculate the second actuator control signal Y'c based on a function of the at least one processing target, the at least one predefined system and pump limit, and the first actuator control signal if the at least one actual operating parameter exceeds the at least one predefined system and pump limit, and to calculate the second actuator control signal Y'c based on a function of the at least one processing target, the at least one actual operating parameter, and the first actuator control signal if the actual operating speed does not exceed the at least one predefined system and pump limit.

13. The system of claim 11, wherein the controller is configured to calculate the third actuator control signal Y''c based on a function of the at least one processing target, the at least one predefined system and pump limit, and the first actuator control signal if the at least one actual operating parameter exceeds the at least one predefined fluid limit, to calculate the third actuator control signal Y''c based on a function of the at least one processing target, the at least one actual operating parameter, and the first actuator control signal if the actual operating speed does not exceed the at least one predefined fluid limit.

14. The system of claim 11, wherein the controller is configured to calculate the fourth actuator control signal Y'''c based on a function of the at least one processing target, the at least one predefined normal processing limit, and the first actuator control signal if the at least one actual operating parameter exceeds the at least one predefined normal processing limit, and to calculate the fourth actuator control signal Y'''c based on a function of the at least one processing target, the at least one actual operating parameter, and the first actuator control signal if the actual operating speed does not exceed the at least one predefined normal processing limit.

15. The system of claim 11, wherein the controller is configured to calculate the fifth actuator control signal Y''''c based on a function of the at least one processing target, the at least one predefined abnormal processing limit, and the first actuator control signal if the at least one actual operating parameter exceeds the at least one predefined abnormal processing limit, and to calculate the fifth actuator control signal Y''''c based on a function of the at least one processing target, the at least one actual operating parameter, and the first actuator control signal if the actual operating speed does not exceed the at least one predefined abnormal processing limit.

16. The system of claim 11, wherein the at least one processing target includes at least one of a target pump speed, a target pump suction pressure, a target pump differential pressure, a target pump discharge pressure, a target pump flow, and a target fluid temperature.

17. The system of claim 11, wherein the at least one system and pump limit includes at least one of a system speed limit, a system pressure limit, a system flow rate limit, a system temperature limit, a pump speed limit, a pump suction pressure limit, a pump discharge pressure limit, a pump differential pressure limit, a pump viscosity limit, and a pump vibration limit.

18. The method of claim 11, wherein the at least one normal processing limit includes at least one of a processing speed limit, processing suction pressure limit, processing discharge pressure limit, processing differential pressure limit, processing flow rate limits, processing temperature limit, and a processing vibration limit.

19. The method of claim 11, wherein the at least one abnormal processing limit includes at least one of a cavitation severity limit, a dry-running severity limit, an air bubble severity limit, a pump flow as a flow meter limit, a pump efficiency limit, a bearing lubrication health limit, a leak rate and trend limit, a severe external leakage limit, and a FFT analysis from vibration limit.

20. The system of claim 11, wherein the most conservative actuator control is associated with at least one of a lowest pump speed, a lowest pump pressure, a lowest pump temperature, and a lowest pump flow rate.

* * * * *